US005126719A

United States Patent [19]

DeSorbo

[11] Patent Number: 5,126,719

[45] Date of Patent: Jun. 30, 1992

[54] REMOTELY ARMED ALARM SYSTEM

[76] Inventor: John DeSorbo, 28 Orchard La., Waterbury, Conn. 06705

[21] Appl. No.: 527,330

[22] Filed: May 23, 1990

[51] Int. Cl.[5] ..... G08B 13/14

[52] U.S. Cl. ..... 340/571; 340/539

[58] Field of Search ..... 340/426, 429, 571, 539

[56] References Cited

U.S. PATENT DOCUMENTS

| | | | |
|---|---|---|---|
| 3,500,376 | 3/1970 | Cooper | 340/571 |
| 3,551,906 | 12/1970 | Cooper | 340/571 |
| 3,721,956 | 3/1973 | Hamman et al. | 340/429 |
| 4,117,468 | 9/1978 | Vasquez | 340/571 |
| 4,204,202 | 5/1980 | Pai | 340/571 |
| 4,376,935 | 3/1983 | Castaldo | 340/571 |
| 4,385,288 | 5/1983 | Bitko | 340/571 |
| 4,462,023 | 7/1984 | Nielsen et al. | 340/571 |
| 4,591,835 | 5/1986 | Sharp | 340/571 |
| 4,804,943 | 2/1989 | Soleimani | 340/539 |
| 4,866,417 | 9/1989 | DeFino et al. | 340/429 |
| 4,885,572 | 12/1989 | Iwata et al. | 340/429 |
| 4,922,224 | 5/1990 | Drori et al. | 340/426 |

*Primary Examiner*—Edward L. Coles, Sr.
*Assistant Examiner*—Jill Jackson
*Attorney, Agent, or Firm*—John H. Crozier

[57] ABSTRACT

In a preferred embodiment, a remotely armed alarm system which is useful in protecting a personal article, which system includes a motion-activated receiver/alarm disposed in the article. The receiver/alarm is armed in response to a first RF signal from a remote transmitter/controller and is disarmed in response to a second RF signal from the transmitter/controller. The receiver/alarm produces an audible sound when the article is moved, the type of sound, i.e., continuous or discontinuous, being selectively determined by the transmitter/controller. The alarm sounds for a predetermined length of time after each movement of the article.

7 Claims, 1 Drawing Sheet

REMOTELY ARMED ALARM SYSTEM

BACKGROUND OF THE INVENTION

1. Field of the Invention

The present invention relates generally to remote alarm systems for personal articles, such as coats, purses, briefcases, and the like and, more particularly, to a novel alarm system that is remotely and selectively armed and disarmed.

2. Background Art

There have been many attempts to provide alarm systems for personal articles. Some of these include audible alarm means in the article which sound when the article is moved. The activation of the alarm means may be in response to vibration, movement, opening a lid, or similar physical forces. With some of these, a remote alarm may be activated by the alarm means also. Other devices are audible alarm means disposed in an article to be detected, which alarm means is remotely caused to sound by a person having a remote transmitter who observes the article being removed by an authorized person, the transmitter transmitting a signal which causes the alarm means to sound. The latter devices suffer from the disadvantage that the alarm will not be activated unless the unauthorized removal is observed.

In all these previously known devices, there is no convenient method for arming or disarming self-contained alarm means. With most of such devices, the alarm device is armed and disarmed by the manual setting of buttons, switches, or key locks, or, in some cases, the arming and disarming is accomplished by the insertion or removal of a battery. While such manual arming and disarming works satisfactorily, it is relatively clumsy and time consuming, requires a person to handle the article in which the alarm is contained and may require removing personal items from a purse or briefcase to access the manual setting means.

Accordingly, it is a principal object of the present invention to provide alarm means for personal objects, such as coats, purses, briefcases, and the like, that can be remotely armed and disarmed.

It is an additional object of the invention to provide such alarm means that is economical to manufacture and simple to use.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a remotely armed alarm system which is useful in protecting a personal article, which system includes a motion-activated receiver/alarm disposed in the article. The receiver/alarm is armed in response to a first RF signal from a remote transmitter/controller and is disarmed in response to a second RF signal from the transmitter/controller. The receiver/alarm produces an audible sound when the article is moved, the type of sound, i.e., continuous or discontinuous, being selectively determined by the transmitter/controller. The alarm sounds for a predetermined length of time after each movement of the article.

BRIEF DESCRIPTION OF THE DRAWING

The understanding of the features of the present invention will be facilitated by reference to the accompanying drawing figures, in which.

DETAILED DESCRIPTION OF THE PREFERRED EMBODIMENTS

Figure 1:
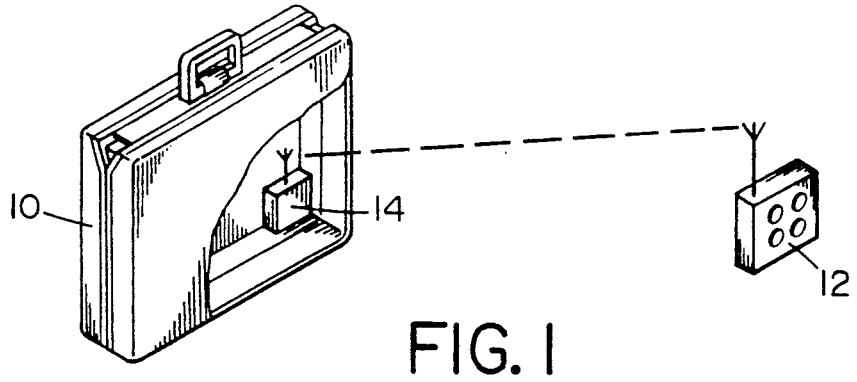
FIG. 1 is a schematic view, partially in cut away, of the present invention employed in protecting a briefcase.

Referring now to the Drawing, in which similar elements of the invention are given consistent identifying numerals throughout the various figures thereof, FIG. 1 is a schematic view of the present invention as used with a briefcase 10, the present invention including a controller/transmitter 12 and a receiver/motion-activated alarm 14, the latter element being responsive to the controller/transmitter by means of radio-frequency (RF) signals. As is more fully described below, alarm 14 is disposed within briefcase 10 to protect the same from theft. Alarm 14 is armed by means of a selective RF signal transmitted from controller/transmitter 12 and, when armed, will sound a selected alarm signal when briefcase 10 is moved.

Figure 2:
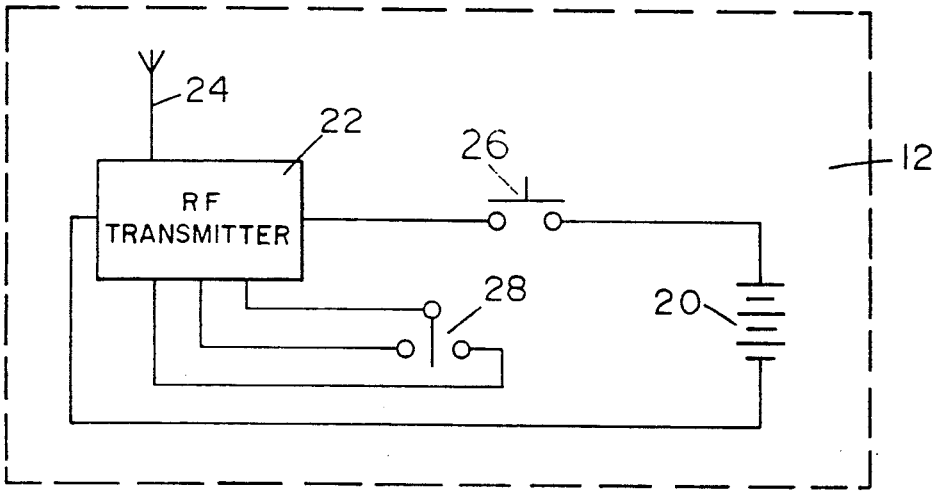
FIG. 2 is a block/schematic diagram of the transmitter/controller of the present invention.

Referring now to FIG. 2, controller/transmitter 12 includes a source of electrical power, such as a battery 20. Battery 20 is connected to provide power to an RF transmitter 22, having an associated antenna 24, when momentary contact switch 26 is closed. Controller/-transmitter 12 further includes a two-position switch 28 operatively connected to RF transmitter 22.

Figure 3:
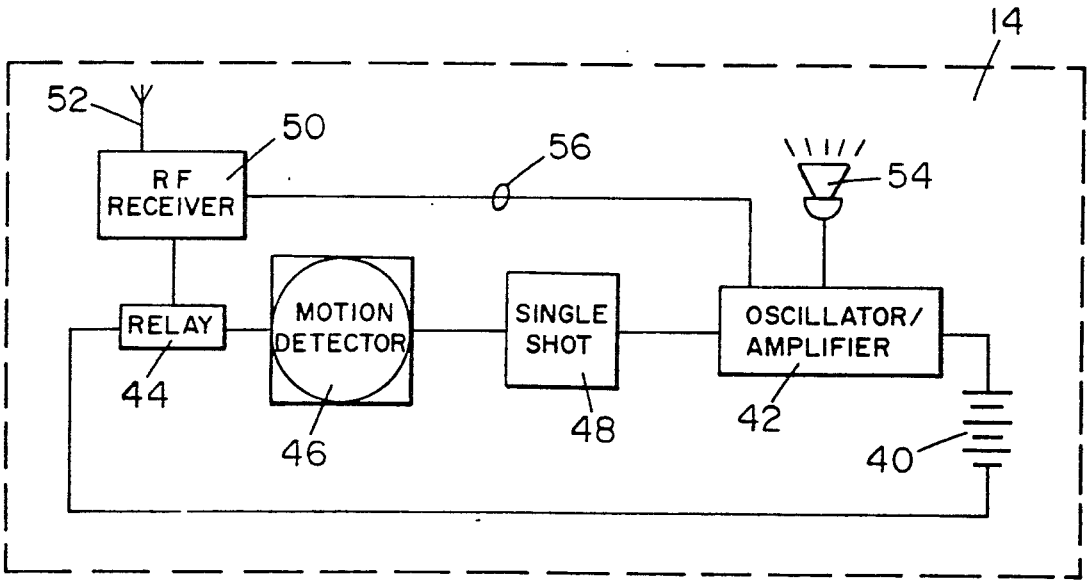
FIG. 3 is a block/schematic diagram of the receiver-/alarm of the present invention.

Referring now to FIG. 3, receiver/alarm 14 includes a source of electrical power, such as a battery 40. Battery 40 provides power to an oscillator/amplifier 42 through a normally open relay 44, a motion sensor 46, and a single-shot circuit 48 connected in series with the battery. Relay 44 is operable in response to a signal from an RF receiver 50, having an associated antenna 52. Receiver/alarm 14 further includes a speaker 54 driven by oscillator/amplifier 42.

In use, receiver/alarm 14 is placed into, or built into the structure of, briefcase 10. When a person wishes to arm receiver/alarm 14, he presses momentary contact switch 26 in controller/transmitter 12. When momentary contact switch 26 is closed, power is supplied to RF transmitter 22 which momentarily transmits an RF signal through antenna 24, the RF signal being received by antenna 52 on RF receiver 50. RF receiver 50 provides an input signal to normally open relay 44 which closes in response to the input signal. The circuit to furnish power to oscillator/amplifier 42 is now closed, save for normally open motion sensor 46 and single shot circuit 48. Receiver/alarm 14 is now armed.

Now, when briefcase 10 is moved, normally open motion sensor 46 closes which activates single-shot circuit 48 which, in turn, causes oscillator/amplifier 42 to cause speaker 54 to emit an audible alarm for a predetermined length of time. The type of audible alarm emitted by speaker 54 is determined by the setting of two-position switch 28 in controller/transmitter 12, for example, one setting of the switch causing a continuous alarm and the other setting of the switch causing a discontinuous alarm, or a "beeping" sound. The latter type of sound being able to draw more attention to the movement of briefcase 10 in some circumstances. The setting of two-position switch 28 is coded in the arming signal transmitted via RF transmitter 22 and antenna 24 to receiver/alarm 14 and generates an appropriate input signal to oscillator/amplifier 42 through lead 56.

The sound emitted by speaker 42 is designed to cause a thief attempting to steal briefcase 10 to leave the briefcase and alerts the owner thereof and others in the vicinity to the activity. The length of time single-shot circuit 48 activates oscillator/amplifier 42 is chosen such that it is long enough that the thief will be dissuaded from taking the briefcase, but short enough that if receiver/alarm 14 is activated accidentally, for some reason, the sound therefrom will not become a nuisance. A suitable length of time may be on the order of 5–10 seconds. While this is a relatively short period of time, if briefcase 10 is not left by the thief immediately, further movement will cause single-shot circuit 48 to be continually reset by motion sensor 46, so that speaker 54 will sound continuously.

Whenever the person having transmitter/controller 12 wishes to disarm receiver/alarm 14, he merely presses momentary contact switch 24, causing RF transmitter 22 to transmit a second signal to RF receiver 50 which, in turn, causes relay 44 to open. Receiver/alarm 14 is now disarmed. The reasons for disarming receiver/alarm 14 may include the person wishing to move briefcase 10 himself, he may observe that the briefcase is about to be moved by an authorized person, or the receiver/alarm may have been activated accidentally. In any case, disarming of receiver/alarm 14 is accomplished quickly and easily without the person having to touch the briefcase.

The components and circuitry of controller/transmitter 12 and receiver/alarm 14 are commercially available and/or the structures thereof are well known by those skilled in the art and are economically purchased and/or are constructed.

It will be understood that, while the present invention has been described in the context of providing theft protection for a briefcase, it may be applied as well to the protection of any of a number of personal articles, such as for example, without limitation, coats, purses, and suitcases.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A remotely armed alarm system, comprising:

(a) a portable case for carrying personal articles;

(b) remote controller means;

(c) motion-activated alarm means disposed in said portable case, said motion-activated alarm means being selectively armable in response to a first signal from said remote controller means when said portable case is reposed at a location; and (d) said motion-activated alarm means, when armed, providing an alarm signal when said portable case is and removed from said location.

2. A remotely armed alarm system, as defined in claim 1, wherein said motion-activated alarm means is disarmable in response to a second signal from said remote controller means.

3. A remotely armed alarm system, as defined in claim 1, wherein said motion-activated alarm means causes said audible alarm signal to sound for a predetermined length of time after said article is moved.

4. A remotely armed alarm system, as defined in claim 1, wherein said motion-activated alarm means includes:

(a) RF receiver means to receive said first signal and to produce an output in response thereto;

(b) normally open motion sensor means;

(c) audible sound producing means connected to said normally open motion sensor means to produce an alarm in response to movement of said article; and (d) means to arm said motion-activated alarm means by connecting said normally open motion sensor means to a source of electrically power in response to the output of said RF receiver means.

5. A remotely armed alarm system, as defined in claim 1, wherein said motion-activated alarm means produces an alarm signal for a predetermined length of time in response to movement of said article.

6. A remotely armed alarm system, as defined in claim 1, wherein said remote controller means includes:

(a) RF transmitter means; and (b) first switch means to connect a source of electrical power to said RF transmitter means such that said RF transmitter means transmits said first signal to said receiver/alarm means.

7. A remotely armed alarm system, as defined in claim 6, wherein said RF transmitter means transmits said first signal for a short period of time.

* * * * *